US009095949B2

(12) United States Patent
Menegon

(10) Patent No.: US 9,095,949 B2
(45) Date of Patent: Aug. 4, 2015

(54) SHARPENING DEVICE FOR CUTTING BLADE

(76) Inventor: Ennio Menegon, San Giuseppe di Cassola (IT)

( * ) Notice: Subject to any disclaimer, the term of this patent is extended or adjusted under 35 U.S.C. 154(b) by 3 days.

(21) Appl. No.: 14/112,014

(22) PCT Filed: Apr. 20, 2011

(86) PCT No.: PCT/IB2011/051710

§ 371 (c)(1),
(2), (4) Date: Oct. 28, 2013

(87) PCT Pub. No.: WO2012/143755

PCT Pub. Date: Oct. 26, 2012

(65) Prior Publication Data

US 2014/0057537 A1 Feb. 27, 2014

(51) Int. Cl.

| | |
|---|---|
| ***B24B 21/02*** | (2006.01) |
| ***B24B 27/00*** | (2006.01) |
| ***B24B 3/54*** | (2006.01) |
| ***B24B 21/00*** | (2006.01) |

(52) U.S. Cl.

CPC ..... *B24B 27/0076* (2013.01); *B24B 3/54* (2013.01); *B24B 21/002* (2013.01)

(58) Field of Classification Search

CPC ..... B24B 21/002; B24B 3/54; B24B 21/004; B24B 21/02

USPC ..... 451/302, 45, 168, 350, 355, 486, 307, 451/311, 361; 76/82, 86, 87

See application file for complete search history.

(56) References Cited

U.S. PATENT DOCUMENTS

| | | | | | |
|---|---|---|---|---|---|
| 2,124,592 | A * | 7/1938 | Schaefer | 451/302 |
| 2,124,593 | A * | 7/1938 | Schaefer | 451/302 |
| 2,222,361 | A * | 11/1940 | Burns | 451/302 |
| 2,262,401 | A * | 11/1941 | Meade et al. | 451/486 |
| 2,319,311 | A * | 5/1943 | Evans | 451/361 |
| 2,391,322 | A * | 12/1945 | Lundquist | 451/302 |
| 3,526,061 | A * | 9/1970 | Battocchi | 451/241 |
| 4,617,763 | A * | 10/1986 | Edling | 451/302 |
| 5,168,656 | A * | 12/1992 | Jolly et al. | 451/310 |
| 5,299,659 | A * | 4/1994 | Imbeault et al. | 414/592 |
| 5,407,380 | A * | 4/1995 | Salkewicz | 451/340 |
| 5,573,450 | A * | 11/1996 | Markocic et al. | 451/76 |
| 7,156,728 | B1 * | 1/2007 | Killough | 451/361 |
| 7,179,157 | B2 * | 2/2007 | Wheeler et al. | 451/361 |
| 7,878,753 | B2 * | 2/2011 | Kielian et al. | 414/800 |
| 8,282,448 | B2 * | 10/2012 | Loehnert | 451/523 |
| 2004/0132391 | A1 * | 7/2004 | Kodaverdian et al. | 451/350 |
| 2004/0166774 | A1 * | 8/2004 | Cochran et al. | 451/11 |

(Continued)

FOREIGN PATENT DOCUMENTS

| | | |
|---|---|---|
| DE | 886254 | 8/1953 |
| DE | 102008033547 | 1/2010 |

(Continued)

*Primary Examiner* — George Nguyen

(74) *Attorney, Agent, or Firm* — Themis Law

(57) ABSTRACT

A sharpening device for cutting blades includes a support shell, at least two rollers rotatably mounted to the shell for rotating about respective substantially parallel first rotation axes and offset along a first substantially radial center-to-center direction, the rollers having respective contiguous grinding peripheral surfaces delimiting a working zone designed to receive a blade to be sharpened, the grinding surfaces being elastically yieldable to conform to the profile of the blade.

11 Claims, 8 Drawing Sheets

(56) References Cited

U.S. PATENT DOCUMENTS

| | | | | |
|---|---|---|---|---|
| 2006/0041448 | A1* | 2/2006 | Patterson et al. | 705/1 |
| 2007/0054608 | A1* | 3/2007 | Liu | 451/361 |
| 2011/0136412 | A1* | 6/2011 | Dovel | 451/45 |

FOREIGN PATENT DOCUMENTS

| | | | | |
|---|---|---|---|---|
| EP | 2014414 | A1 * | 1/2009 | B24B 3/54 |
| GB | 961090 | | 6/1964 | |
| GB | 2168630 | | 6/1986 | |

* cited by examiner

SHARPENING DEVICE FOR CUTTING BLADE

FIELD OF THE INVENTION

The present invention generally finds application in the field of hard material machining devices and particularly relates to a sharpening device for cutting blades, particularly of the type designed for domestic or handicraft use.

BACKGROUND ART

Blade sharpening devices are known which have two or more pairs of grinding rollers or wheels located in mutually facing positions with their respective lateral grinding surfaces in adjacent relation.

The cutting blade is sharpened by being interposed between the two rollers with the blade edge contacting the grinding surfaces and causing the rollers to rotate about respective parallel axes with opposite directions of rotation.

EP 2,014,414 discloses a knife sharpening device that comprises two endless abrasive belts which are mounted in a closed-loop configuration to a drive unit comprising two respective pairs of motorized pulleys in such arrangement as to cause two active branches of the abrasive belts to be in mutually facing and converging positions, a gap being formed therebetween, in which the knife blade to be sharpened may be inserted and sharpened.

The distance between the two abrasive belts may be adjusted by adjusting means to fit the blade size.

Nevertheless, such common solution still suffer from certain drawbacks.

A first drawback consists in that rigid grinding rollers provide a cutting blade having a sharp-edged profile, whose quality is not always acceptable.

Furthermore, these solutions are of no use for ceramic blades, due to the greater fragility of the latter.

An additional drawback of these known solutions is that, during sharpening, the blade has to be pressed against the roller, and is thus heated, which may cause loss of hardness of the material, usually steel.

Yet another drawback is that the top-to-bottom rotation of the grinding surfaces of the rollers causes burr build-up, that forces frequent process stops for burr removal.

A further drawback is that prior art sharpening devices are mounted to fixed shells which set an operating position thereof, and introduction of the blades to be sharpened from both sharpening sides between the grinding members, for better sharpening, requires users to repeatedly move around the device for direct access to each side.

Another drawback is that, during blade sharpening, the user that holds the blades may inadvertently introduce them through an excessive distance between the grinding members, with the blade handles possibly contacting the latter and being damaged by their fast rotation, as soon as contact occurs.

Furthermore, prior art sharpening devices have no protection means, which might prevent the user from accidentally contacting the grinding members also by their hands during operation.

DISCLOSURE OF THE INVENTION

The object of the present invention is to obviate the above drawbacks, by providing a sharpening device for cutting blades that is effective and simple and inexpensive to make.

A particular object is to provide a sharpening device that provides blades with a rounded profile, with no sharp edges, and is thus also adapted for sharpening blades made of fragile materials, such as ceramic materials.

Yet another object of the present invention is to provide a sharpening device that does not alter the mechanical properties of the material that forms the blade.

Another object is to provide a sharpening device that allows adjustment of the working depth of the grinding surfaces.

A further object of the invention is to allow the users to insert the blades to be sharpened from both opposite sides, without having to move around the sharpening devices.

Another object of the invention is to protect the hands of the users from accidental contact with the sharpening members during operation.

Yet another object of the invention is to prevent the handles of the knives whose blades have to be sharpened from accidentally contacting the sharpening members and being irremediably damaged thereby.

In one aspect the invention relates to a sharpening device for cutting blades as defined hereinafter.

The invention affords the following advantages:

- allowing easier sharpening;
- protecting the hands of the users during operation of the sharpening members;
- preventing the parts of the blades not designed for sharpening from accidentally contacting the sharpening members and being irremediably damaged thereby.

Advantageous embodiments of the device are defined by the dependent claims.

BRIEF DESCRIPTION OF THE DRAWINGS

Further characteristics and advantages of the invention will be more apparent upon reading the detailed description of a preferred, non-exclusive embodiment of a blade sharpening device of the present invention, which is described as a non-limiting example with the help of the annexed drawings, in which.

DETAILED DESCRIPTION OF A PREFERRED EMBODIMENT

Figure 1:
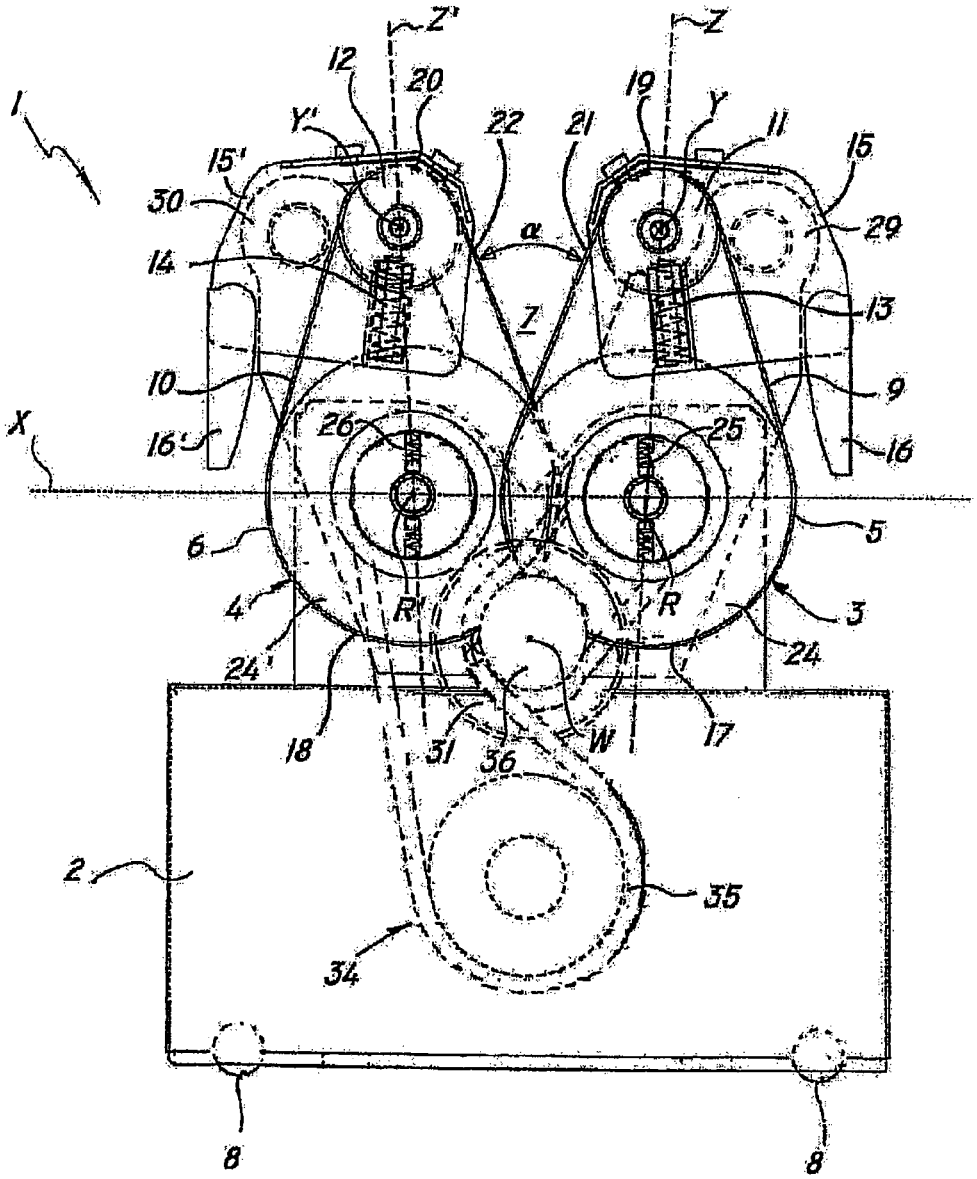
FIG. 1 is a front side view of a device of the invention in a first preferred configuration.

Referring to FIGS. 1 to 6, a blade sharpening device of the invention, generally designated by numeral 1, may be used for sharpening cutting blades of knives, scissors or similar tools for domestic or handicraft use.

As shown in the annexed figures, a device 1 of the invention comprises a support shell 2 with at least two rollers 3, 4 mounted thereto for rotation about respective first axes of rotation R, R' which are substantially parallel and have a preferably, but not exclusively horizontal orientation.

The first axes of rotation R, R' of the rollers 3, 4 are also offset in a first center-to-center direction "X", which is substantially radial and horizontally oriented, with a predetermined center-to-center distance preferably not larger than the maximum diameter of the rollers 3, 4.

The latter are preferably disk-shaped with substantially identical radiuses and have contiguous peripheral grinding surfaces 5, 6 delimiting a working zone 7 for receiving a blade to be sharpened, not shown, and interacting each with a respective side of the blade.

The shell 2 may also have a removable protective shield, not shown, for covering the rollers 3, 4, which has a central slot at the working zone 7 for access by the blade.

The shell 2 also has one or more, preferably four bearing wheels 8, which are mounted to the bottom base to allow rotation of the whole device 1 about a vertical axis, and allow its orientation on the bearing plane, for the user to place it in the most comfortable position, with both blade introduction sides between the grinding surfaces 5 and 6 being accessible without moving out of a workstation.

According to a feature of the invention, the grinding surfaces 5, 6 are formed of an elastically yieldable material to conform to the blade profile.

Particularly, the grinding surfaces 5, 6 are defined by the outer surfaces of corresponding flexible sharpening elements 9, 10 which are wound in a closed-loop configuration around corresponding rollers 3, 4, in at least partially contact with the outer surfaces thereof.

The flexible sharpening elements 9, 10 may be abrasive bands or belts, preferably made of a polymeric material, such as nylon or the like, having abrasive particles or powder, such as diamond powder, arranged over their outer surface.

The flexible annular elements 9, 10 may be in mutually adjacent positions, with their respective grinding surfaces 5, 6 substantially tangent.

Nevertheless, advantageously, the rollers 3, 4 are partially superimposed along the first center-to-center direction "X" and axially offset.

As a result, their respective flexible elements 9, 10 are also axially offset, thereby defining a working zone 7, which axially extends to at least twice their width.

Furthermore, the device 1 is preferably equipped with three rollers 3, 3', 4 associated with respective annular sharpening elements 9, 9', 10 having respective grinding surfaces, with the two end rollers 9, 9' coaxially mounted to a common first axis of rotation "R".

This particular configuration allows quick machining of the whole blade throughout its longitudinal extension and on both sides at the same time.

This configuration is also particularly advantageous for sharpening kitchen knives with handles, as it allows the whole blade to be sharpened to the edge of the handle while ensuring maximum safety to the operator.

As shown in Figures from 7 to 10, two pairs of rigid and specially shaped sheets, referenced 30 and 31 in the figures and hereinafter simply sheets 30 and 31 may be mounted between the rollers 3 and 4 and the corresponding return pulleys 11 and 12.

These sheets 30 and 31 have two opposed straight faces 33 and 34 that form a downwardly tapered, V-shaped concave seat, acting as a support and a guide for the blades "L" to be sharpened, e.g. for the blades "L" of a knife 100 having a handle 101.

Figure 7:
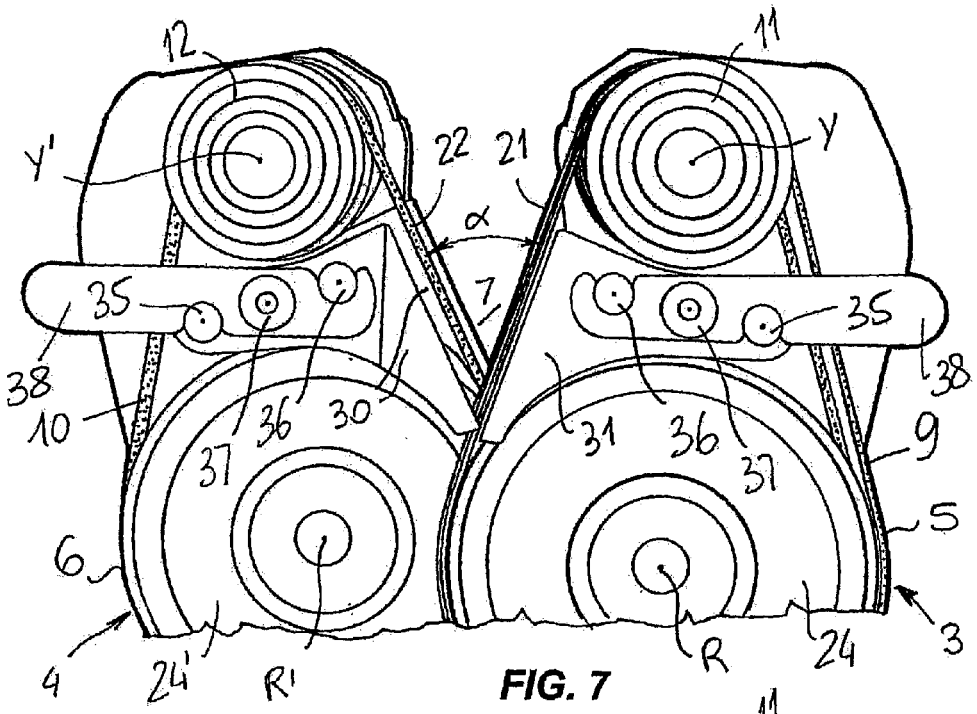
FIG. 7 is a broken enlarged view of a sharpening zone of the sharpening device of the invention.
Figure 8:
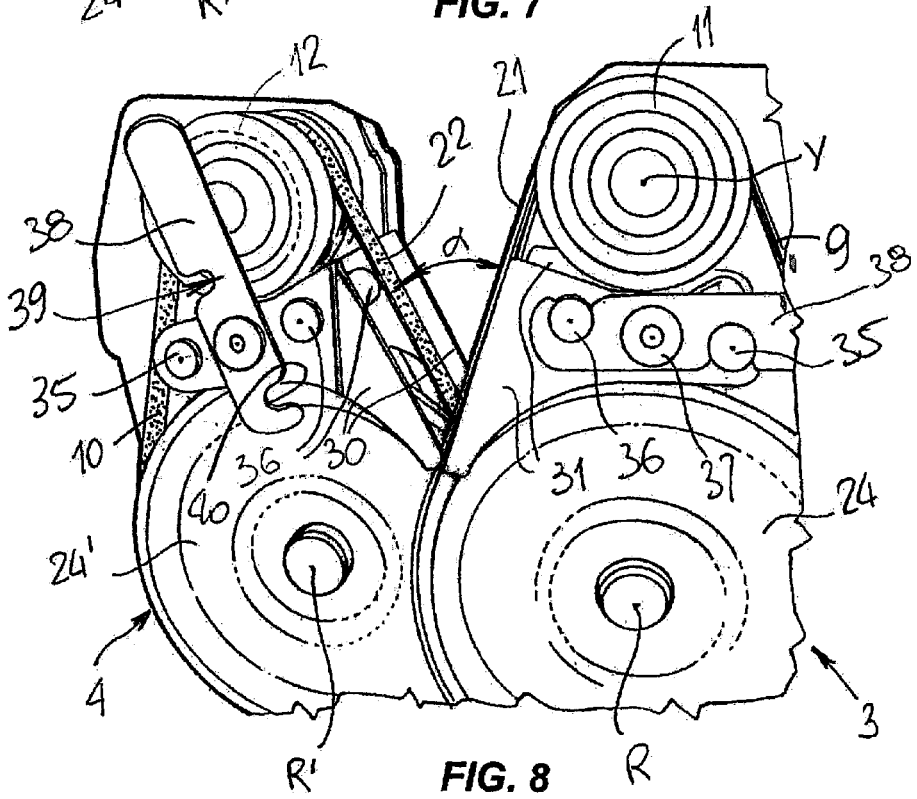
FIG. 8 is a broken and enlarged view of the sharpening zone of FIG. 7.

The opposed faces 33 and 34, as shown in FIGS. 7 and 8, substantially follow the profile of intermediate facing sections 21 and 22 of the grinding surfaces 5 and 6 and the sheets 30 and 31 as a whole prevent a user from contacting the latter, thereby acting as protective elements.

At least one pair of specially shaped sheets 30 and 31 are removable to allow replacement of the flexible annular sharpening elements 9 and 10 as needed.

As shown in the figures, the two removable sheets 30 and 31 are fitted onto respective transverse pins 37, which hold them in a guided position for the opposed faces 33 and 34 to substantially coincide with the profiles of the intermediate sections 21 and 22, whereas a stop member 38, which is rotatably mounted to the stop member 38 on the outer side of the sheets 30 and 31, locks them in their operating position or unlocks them.

As shown in the figures, the sheets 30 and 31 are fitted not only on the pins 37, but also on additional pairs of transverse pins 35 and 36, whose respective ends project out of the sheets 30 and 31 and are designed for engagement in corresponding recesses 39 and 40 formed on opposite sides of the stop element 38.

Figure 9:
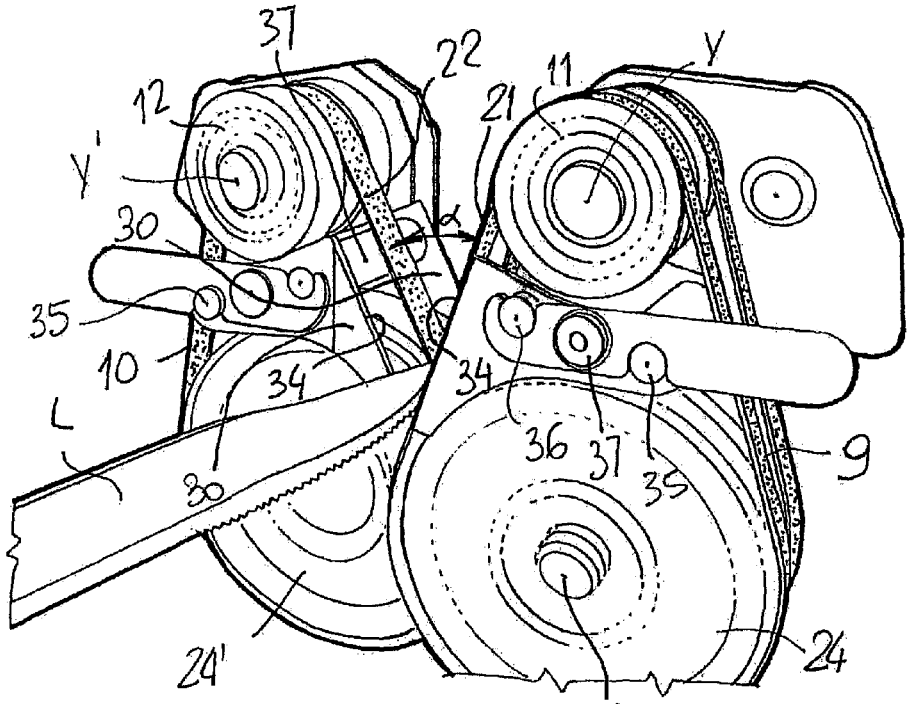
FIG. 9 is a broken and enlarged view of the sharpening zone of FIG. 7 during sharpening of the tip of a knife blade.
Figure 10:
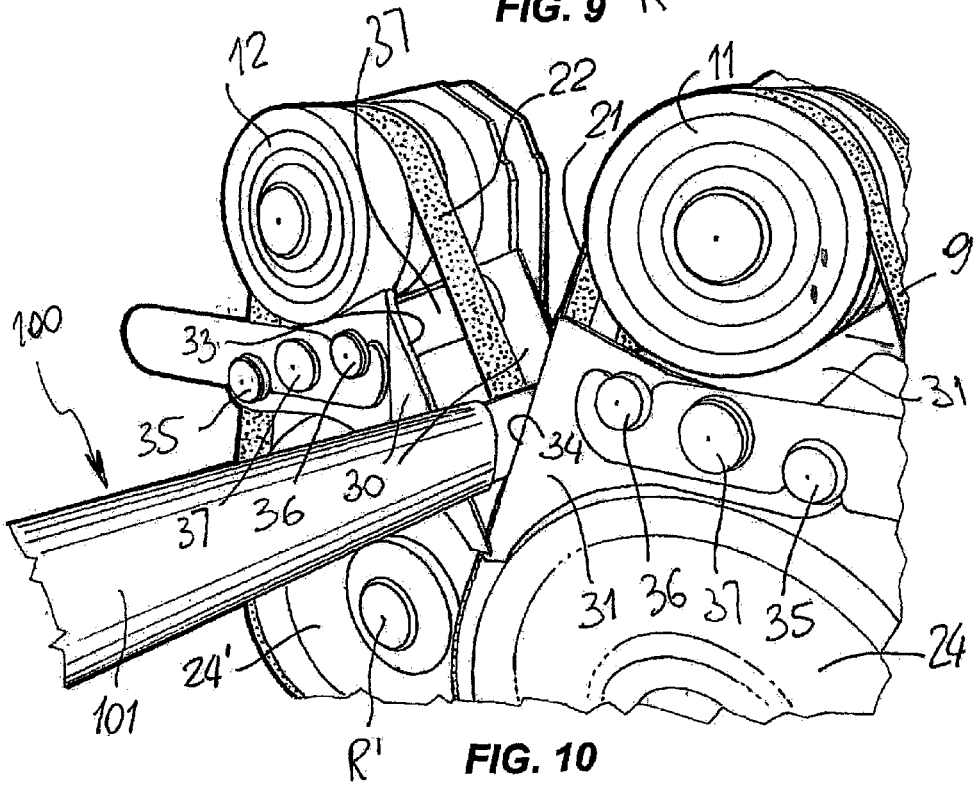
FIG. 10 is a broken and enlarged view of the sharpening zone of FIG. 7 during sharpening of the zone close to the knife handle.
Figure 11:
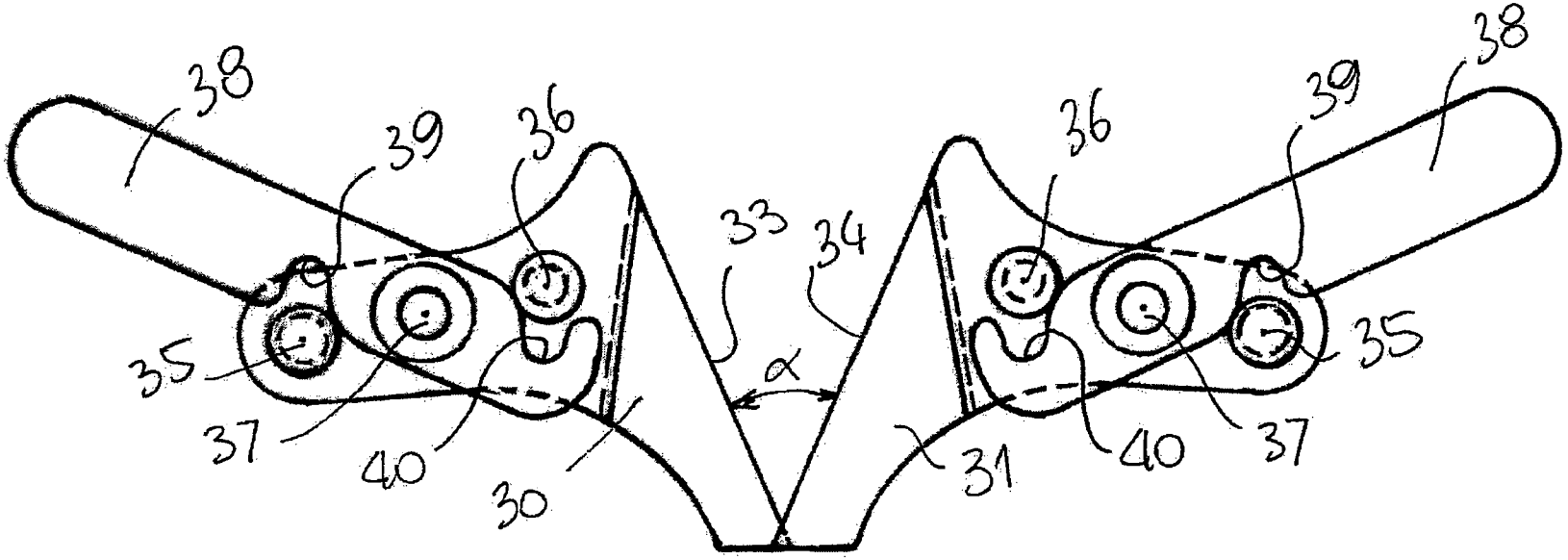
FIG. 11 is a view of protecting elements isolated from the sharpening device of the invention.

The sheets 30 and 31 are locked or unlocked by rotating the stop element 38 from one locked position, as shown in FIGS. 7, 9, 10 to an unlocked position, as shown in FIG. 8 (showing the partial unlock of the sheet 30 to the left of the viewer) and in FIG. 11.

In the unlocked condition, the sheets 30 and 31 may be slipped off the pins 35, 36 and 37 and removed for access to the flexible annular sharpening elements 9 and 10.

As shown in FIG. 10, the two opposed faces 33 and 34 also act as abutments to stop insertion of the knife 100 at the same length as the blade "L", because the handle 101 abuts against the two opposed faces 33 and 34 that prevent excessively deep insertion of the knife between the flexible annular sharpening elements 9 and 10, which would irremediably damage the handle 101.

The device 1 also comprises tensioning means for holding the annular sharpening elements 9, 9' 10 under tension and limiting bending thereof in response to the pressure exerted by the blade.

Particularly, the tensioning means include, for each of the flexible elements 9, 9', 10, a return pulley 11, 11', 12 associated with a corresponding roller 3, 3', 4 and capable of rotating about a support axis "Y", "Y'" substantially parallel to the first axis of rotation "R", "R'" of the roller 3, 3', 4 with which each pulley 11, 11', 12 is operably associated.

Each of the sharpening elements 9, 9', 10 is wound in a closed-loop configuration around its respective roller 3, 3', 4 and the corresponding return pulley 11, 11', 12.

Figure 2:
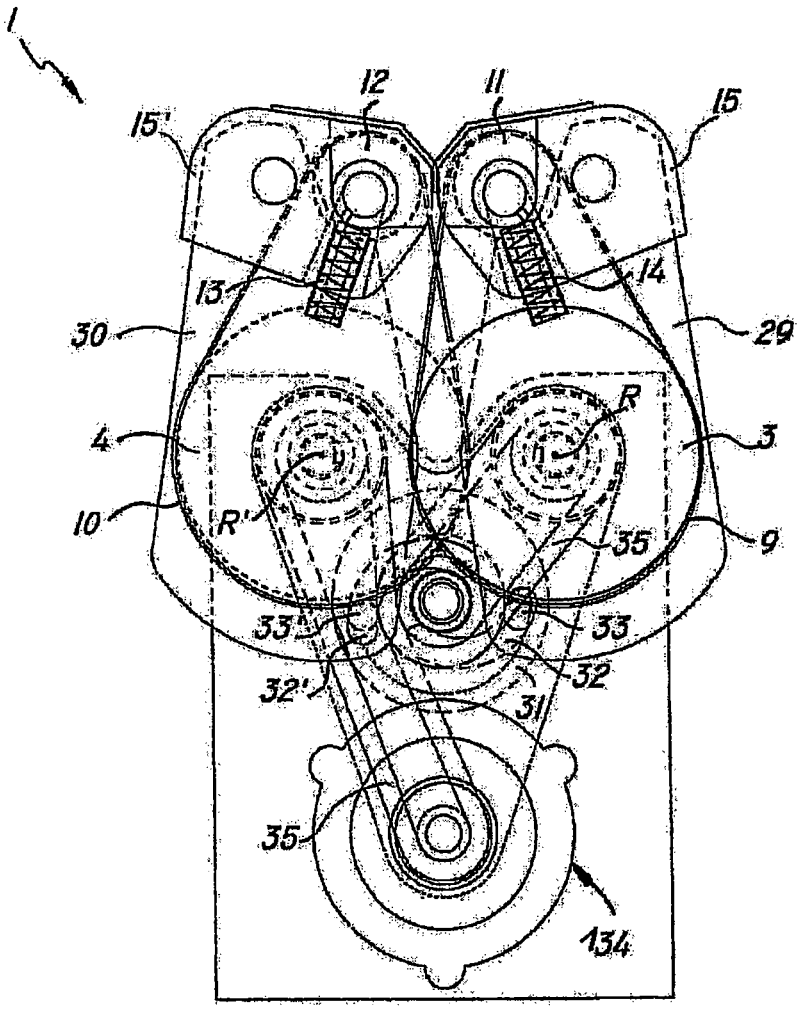
FIG. 2 is a front side view of a device of the invention in a second preferred configuration, with certain details being omitted.
Figure 3:
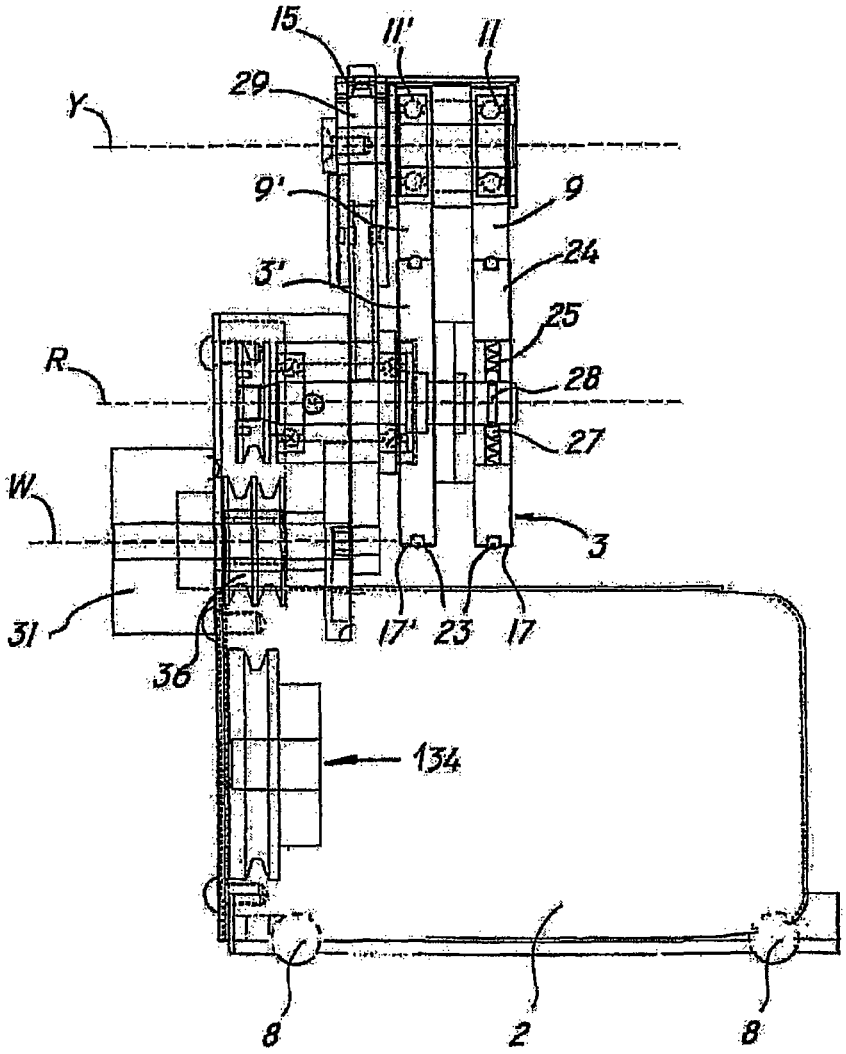
FIG. 3 is a first broken-away partial side view of the device of FIG. 1.

As shown in FIG. 1 and FIG. 2, the return pulleys 11, 11', 12 have support axes "Y", "Y'" offset along respective second center-to-center directions "Z", Z'" relative to the first axis of rotation "R", "R'" of the corresponding roller 3, 3', 4.

The second center-to-center directions "Z", "Z'" are mutually inclined at a predetermined angle, which may be, but is not necessarily, adjustable.

The support axes "Y", "Y'" are also adapted to be translated along their respective second center-to-center directions "Z", "Z'" for quick and simple mounting and removal of the annular flexible elements 9, 9', 10.

For example, for each of the roller-pulley pair 3, 11; 3', 11'; 4, 12, the tensioning means include a first elastic element, two of such elements, referenced 13, 14, being only shown in the figures, which is interposed between the axis of rotation "R", "R'" of the roller 3, 3', 4 and the support axis "Y", "Y'" of the corresponding return pulley 11, 11', 12.

The first elastic elements 13, 14, preferably but without limitation comprising helical springs, are calibrated with predetermined forces to bias the support axes "Y", "Y'" of the pulleys 11, 11', 12 away from the associated rollers 3, 3', 4 and putting the flexible sharpening elements 9, 9', 10 under tension.

This also ensures integral rotation of each roller 3, 3', 4 with the pulley 11, 11', 12 and the sharpening element 9, 9', 10 associated therewith.

In a particularly advantageous embodiment of the invention, the tensioning means may include a pair of protective half-shells 15, 15' covering the pulleys 11, 11' and 12 respectively, that might also replace the protective shield.

In a particular configuration, the protective half-shells 15, 15' are also equipped with respective release levers 16, 16' operably associated with the first elastic elements 13, 14.

Particularly, the outward opening movement of the levers 16, 16' causes each of the pulleys 11, 11', 12 to move toward its respective roller 3, 3', 4 thereby compressing the first elastic elements 13, 14 and allowing removal of the sharpening elements 9, 9', 10.

In the illustrated configuration, each of the sharpening elements 9, 9', 10 has first curved end portions and second curved end portions 19, 19', 20, only those of the front and rear rollers 3, 4 being shown and referenced 17, 18 and 19, 20 respectively, which are wound around and in contact with corresponding rollers 3, 3', 4 and corresponding return pulleys 11, 11', 12 respectively.

Furthermore, each sharpening element 9, 9', 10 has an inner intermediate section 21, 22 which is separate from the rollers 3, 3', 4 and the pulleys 11, 11', 12 and with the inner intermediate separate sections of the other sharpening elements 9, 9', 10, delimits the working zone 7.

Advantageously, the rollers 3, 3', 4 and the return pulleys 11, 11', 12 have respective outer lateral surfaces having an annular bearing ridge 23 for the flexible elements 9, 9', 10, to cause bending thereof.

Thus, the annular sharpening elements 9, 9', 10 interact with the blade only by part of their width, which will ensure higher accuracy and improved control of the sharpening process by the user.

The annular ridges 23 may be defined by rubber rings, e.g. those known as "O-rings" or the like, arranged over the outer lateral surface of the rollers 3, 3', 4 and the pulleys 11, 11', 12 and possibly permanently held in corresponding peripheral grooves thereof, not shown.

Advantageously, the annular ridges 23 are also useful to hold and balance their respective sharpening elements 9, 9', 10.

Figure 12:
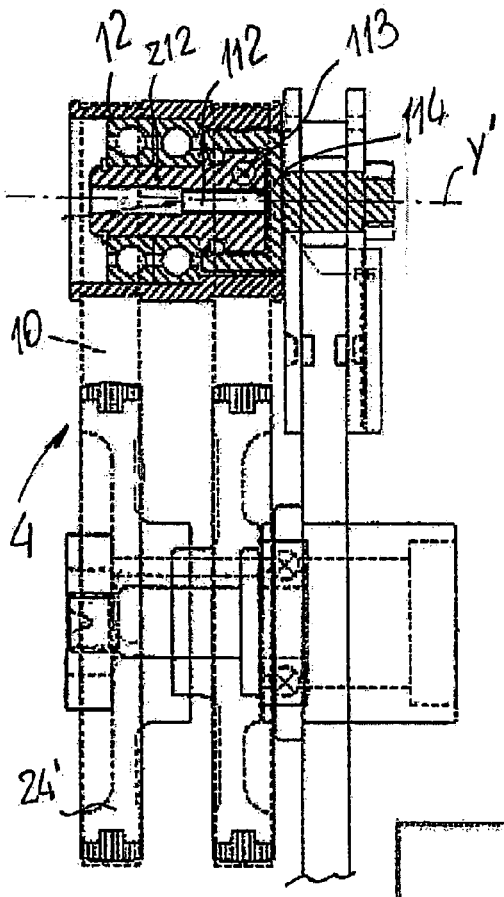
FIG. 12 is a sectional, enlarged view of a part of FIG. 4.

Referring to FIG. 12, the holding and balancing feature is shown to be possibly obtained by slightly adjusting the inclination of the support axes "Y", "Y'".

This adjustment is performed from the outside on the fixing pin 112 of the rotation shaft 212 of the pulleys 11 and 12; as shown in the figure, this pin is hinged at a hinge point 113 to a support flange 114.

By tightening or loosening the fixing pin 112, the latter acts against the outer surface of the support flange 114, and causes the rotation shaft 212 to rotate and be inclined upwards with the support axes "Y" and "Y'", to prevent the annular ridges 23 from being climbed over by the annular sharpening elements.

In an additional preferred configuration, one or more rollers 3, 3', 4 consist of an outer ring 24, 24' which is removably mounted to its respective axis of rotation "R", "R'".

Particularly, the outer rings 24, 24' are associated with their respective first axes of rotation "R", "R'" through elastic and releasable fastening means, allowing selective mounting and removal thereof.

For instance, the fastening means may include a pair of substantially radial second elastic elements 25, 26 which press against the inner face of the rings 24, 24', possibly with a retaining ring, not shown, interposed therebetween.

The second elastic elements 25, 26 have an outer section which directly or indirectly acts on the rings 24, 24' and an inner section that presses against a retaining ring 27, 27' inserted in a peripheral groove 28, 28' in its respective axis of rotation "R", "R'".

Thus, with the second elastic elements 25, 26 under maximum expansion, the rings 24, 24' will rotate integrally with their respective first axes of rotation "R", "R'".

Conversely, compression of the second elastic elements 25, 26 allows release of the rings 24, 24' from the first axes of rotation "R", "R'", and removal of the rollers 3, 4.

This will provide access to the rear rollers 3', 4, which will simplify replacement of the sharpening elements 9', 10.

Advantageously, the device 1 includes means for adjusting the angle a between the intermediate sections 20, 21 of the sharpening elements 9, 10.

The adjustment means may be operable by changing the angle " " between the second center-to-center directions "Z", "Z'", to consequently adjust the clearance angle at which each of the sharpening elements 9, 9', 10 will act on the blade, and hence the running depth, for variably fine sharpening processes.

The angle $\alpha$ delimited by the opposed intermediate sections 21, 21', 22 will be preferably adjustable over a range from 20° to 50°, more preferably from 26° to 45°.

The adjustment means will include, for instance, a pair of substantially plate-like vertical brackets 29, 30 movably mounted to the shell 2.

Each of the brackets 29, 30 integrally supports a first axis of rotation "R", "R'" of the rollers 3, 3', 4 and one of the support axes "Y", "Y'" of the pulley 11, 11', 12 associated with such roller 3, 3', 4.

Particularly, in the illustrated configuration, a first bracket 29 is integral with the common support axis "Y" and axis of rotation "R" for the rollers 3, 3' and the pulleys 11, 11' respectively.

The other bracket 30 integrally supports the support axis "Y'" and the axis of rotation "R'" of the middle roller 4 and pulley 12.

The adjustment means also have a substantially cylindrical actuator element 31, rotating about a second axis of rotation "W" and two kinematic pairs associated with the actuator element 31 and the brackets 29, 20 to cause integral counter-rotation of the latter over a plane substantially orthogonal to the first axes of rotation "R", "R'" of the rollers 3, 3', 4.

Figure 4:
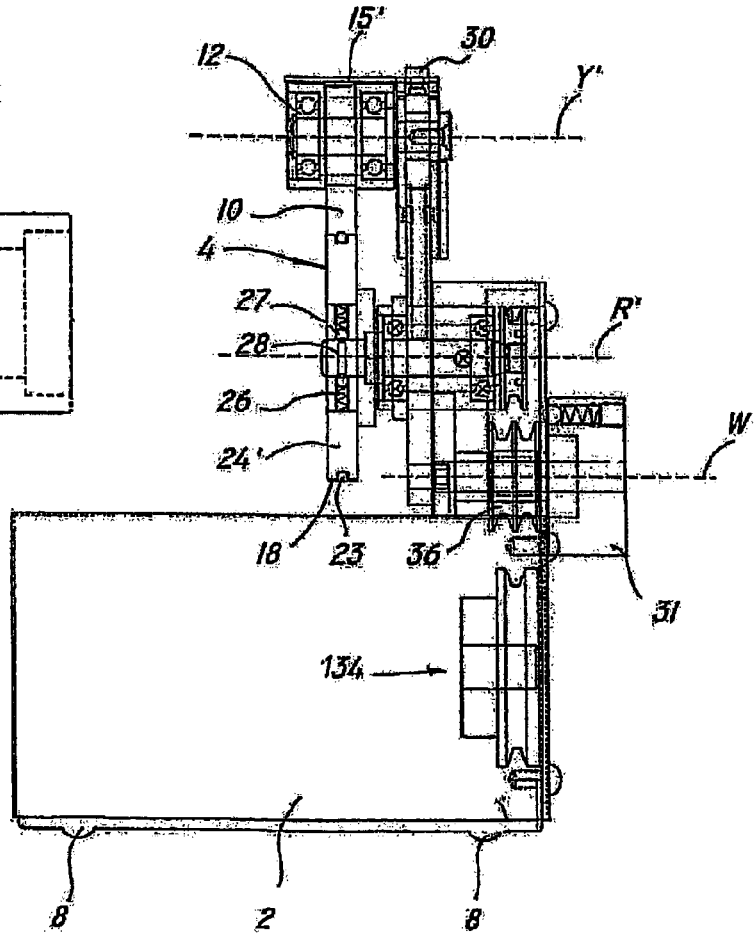
FIG. 4 is a second broken-away partial side view of the device of FIG. 1.
Figure 6:
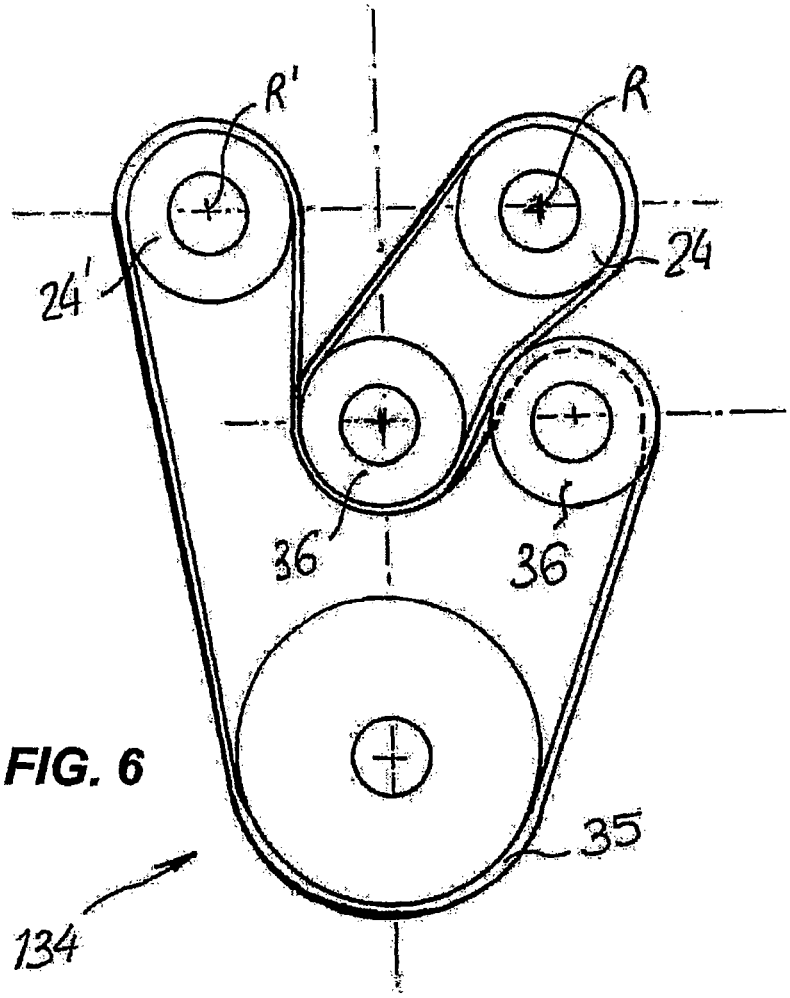
FIG. 6 is a schematic view of a possible embodiment of means of motor means for driving the device of the invention.
Figure 5:
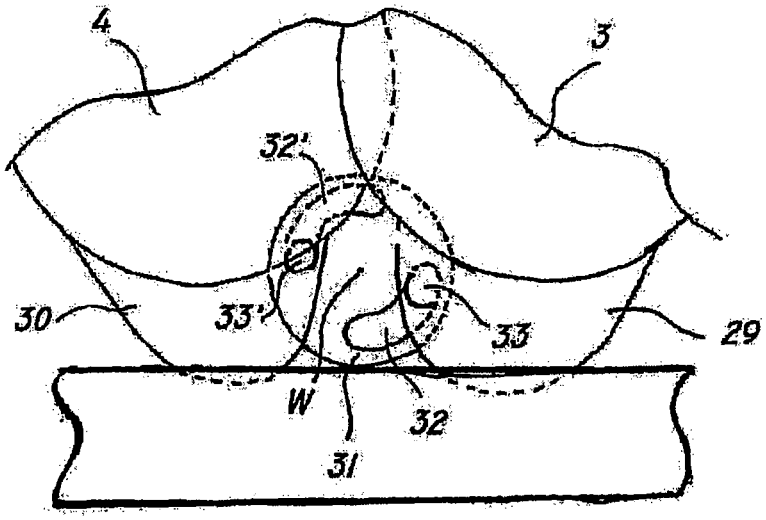
FIG. 5 is an enlarged view of a detail of a device of the invention.

As shown in FIG. 4, each of the kinematic pairs is defined by a curved groove 32, 32' formed on the actuator element 31 and a guide pin 33, 33' integral with a respective bracket 39, 30 and adapted to slidably engage a corresponding groove 32, 32'.

The second axis of rotation "W" of the actuator element 31 is substantially parallel to the first axes of rotation "R", "R'", and the grooves 32, 32' are formed substantially on a plane parallel to the lying plane " " of the brackets 29, 30.

Particularly, the grooves 32, 32' are formed on the inner face of the cylindrical actuator element 31 on opposite sides and symmetrically with respect to the second axis of rotation "W".

Thus, the rotation of the actuator element 31, which may be manually performed by the operator, will cause rotation of the brackets 39, 30 through identical and oppositely directed angles.

In an alternative embodiment, not shown herein, the adjustment means may include a cam member, interposed between the actuator element 31 and the brackets 29, 30.

The rotation of the rollers 3, 3', 4 and the pulleys 11, 11', 12 and hence of the annular sharpening elements 9, 9', 10 associated therewith may be obtained by appropriate motor means 134 associated with at least one of the first axes of rotation "R", "R'" and/or at least one of the support axes "Y", "Y'".

The motor means 134 may include an electric motor, not shown, which is held in the shell 2 and is operably connected to the rollers 3, 3' 4 through one or more drive belts 35 and possibly through return members 36. The belts 35 may have either a circular or a flat section.

On the other hand, the pulleys 11, 11', 12 are rotated by the friction drive created by the annular elements 9, 9', 10.

Furthermore, the motor means 134 are configured to rotate the rollers 3, 4 mounted to different axes of rotation "R", "R'" and hence the corresponding annular sharpening elements 9, 9' at angular speeds of equal modulus and opposite direction and also in such a manner that the annular elements 9, 9' diverge from the working zone 7.

In short, the rotation of the rollers 3, 3', 4 will cause the sharpening elements 9, 9', 10 to move, at the working zone 7, from bottom to top.

With this particular configuration, the sharpening elements 9, 9', 10 exert no pressure on the blade, attenuate the heating effect on it and prevent degradation of its mechanical properties.

Also, burr build-up is prevented, which will provide a quicker a more accurate process as a whole.

In a configuration that is not shown, the motor means 134 may be equipped with switch-operated safety means to control rotation of the rollers 3, 3', 4.

The safety means may be connected, for instance, to the protective shield, to cut off power whenever the shield is opened, thereby preventing any improper use of the device 1, such as its use with the shield removed, and the working zone 7 consequently unprotected.

Furthermore, the safety means may be equipped with a start button with a reset device which is configured to be automatically switched to an open power circuit condition, i.e. with power cut-off, in case of power cut-off.

Particularly, the reset device will require the button to be pressed again upon recovery, in case of power cut-off with the device in operation, to actuate the motor means 134 and cause rotation of the rollers 3, 3', 4.

In another particularly advantageous aspect, the invention provides an assembly of two or more devices 1 of the invention, disposed in adjacent positions and adjusted to operate on the blade with a different running depth for each device 1.

This will allow the blade to be machined with gradually increasing depths, with a first rough grinding operation by the first of the devices and with finer sharpening steps through the other device/s.

The devices 1 of the assembly may be mounted to a turntable, to avoid displacement of the operator from his/her work position, as the blade to be sharpened is moved from one sharpening device to the other.

The sharpening device of the invention is susceptible of a number of changes and variants, within the inventive concept disclosed in the appended claims.

All the details thereof may be replaced by other technically equivalent parts, and the materials may vary depending on different needs, without departure from the scope of the invention.

While the device has been described with particular reference to the accompanying figures, the numerals referred to in the disclosure and claims are only used for the sake of a better intelligibility of the invention and shall not be intended to limit the claimed scope in any manner.

The invention claimed is:

1. A sharpening device for a cutting blade, comprising:

a support shell;

at least two rollers rotatably mounted on said support shell to rotate about respective substantially parallel first rotation axes that are offset along a first substantially radial center-to-center direction, said rollers having respective contiguous grinding peripheral surfaces delimiting a working zone that is designed to receive a blade to be sharpened and is elastically yieldable to follow a profile of the blade, wherein said support shell comprise rotation members that enable a rotation of the sharpening device around a vertical rotation axis, and wherein each of said rollers has a flexible sharpening member wound in a closed loop thereon, each flexible sharpening member having an outside surface defining one of said grinding peripheral surfaces and being made of a polymeric material with grinding particles distributed on said outside surface; and a tensioning system of said flexible sharpening member having, for each member, an intercepting pulley rotatable on a support axis substantially parallel to a first rotation axis of a corresponding roller operatively associated thereto, wherein said tensioning system further comprises a first elastic member interposed between the first rotation axis of each of said rollers and the support axis of the corresponding intercepting pulley.

2. The sharpening device as claimed in claim 1, wherein each flexible sharpening member has a first and a second curved end portion wound on and in contact with a corresponding roller and pulley, and an intermediate detached section delimiting said working zone therebetween.

3. The sharpening device as claimed in claim 2, wherein said working zone comprises a protective device of said intermediate detached section having facing fronts substantially aligned with said intermediate detached section.

4. The sharpening device as claimed in claim 3, wherein said protective device comprises a demountable protective device which is born by pins and is lockable/unlockable by locking/unlocking elements.

5. The sharpening device as claimed in claim 2, wherein the support axes of said pulleys are offset with respect to first rotation axes of the corresponding rollers along second center-to-center directions in angular relationship therebetween, said support axes being respectively movable along said second center-to-center directions.

6. The sharpening device as claimed in claim 3, further comprising an adjusting system for adjusting an angle delimited by the intermediate detached sections of said flexible sharpening members.

7. The sharpening device as claimed in claim 6, wherein said adjusting system comprises a couple of brackets movable on said support shell, each of said brackets firmly supporting a first rotation axis of one of said rollers and the corresponding support axis, said adjusting system further having at least one actuating member and two kinematical couples associated to said actuating member and to said brackets to promote a join rotation with opposite directions of said brackets in a lying plane substantially orthogonal to said first rotation axis.

8. The sharpening device as claimed in claim 7, wherein said actuating member is substantially cylindrical and rotatable on a second rotation axis, each of said kinematical couples comprising a curved slot realized on said actuating member, parallel to said lying plane, and a guide pin joined to a respective bracket and designed to slidably engage said curved slot.

9. A sharpening device for a cutting blade, comprising:

a support shell; and at least two rollers rotatably mounted on said support shell to rotate about respective substantially parallel first rotation axes that are offset along a first substantially radial center-to-center direction, said rollers having respective contiguous grinding peripheral surfaces delimiting a working zone that is designed to receive a blade to be sharpened and is elastically yieldable to follow a profile of the blade, wherein said support shell comprise rotation members that enable a rotation of the sharpening device around a vertical rotation axis, and wherein said rollers are partially overlapped along said first center-to-center direction and axially offset from each other.

10. The sharpening device as claimed in claim 9, wherein at least one of said rollers comprises an external crown removably mounted on the respective first rotation axis, an elastic fastening member being also provided for elastically and removably fastening said crown with said first rotation axis.

11. A sharpening device for a cutting blade, comprising:

a support shell;

at least two rollers rotatably mounted on said support shell to rotate about respective substantially parallel first rotation axes that are offset along a first substantially radial center-to-center direction, said rollers having respective contiguous grinding peripheral surfaces delimiting a working zone that is designed to receive a blade to be sharpened and is elastically yieldable to follow a profile of the blade, wherein said support shell comprise rotation members that enable a rotation of the sharpening device around a vertical rotation axis;

wherein each of said rollers has a flexible sharpening member wound in a closed loop thereon, each flexible sharpening member having an outside surface defining one of said grinding peripheral surfaces and being made of a polymeric material with grinding particles distributed on said outside surface;

a tensioning system of said flexible sharpening member having, for each member, an intercepting pulley rotatable on a support axis substantially parallel to a first rotation axis of a corresponding roller operatively associated thereto, and a motor associated to one or more of said first rotation axes or of said support axes, said motor being susceptible to rotate said rollers with spinning velocities having opposite directions and diverging from said working zone.

* * * * *